US006338686B1

(12) United States Patent
King

(10) Patent No.: US 6,338,686 B1
(45) Date of Patent: Jan. 15, 2002

(54) COMBINATION BASKETBALL AND FOOTBALL GAME

(76) Inventor: Harvey D. King, 233 W. 106th St., Chicago, IL (US) 60628

( * ) Notice: Subject to any disclaimer, the term of this patent is extended or adjusted under 35 U.S.C. 154(b) by 0 days.

(21) Appl. No.: 09/569,634

(22) Filed: May 12, 2000

(51) Int. Cl.[7] ..... A63B 67/00
(52) U.S. Cl. ..... 473/415
(58) Field of Search ..... 473/215, 432, 473/447, 446, 456, 416, 415; 273/317.3, 375

(56) References Cited

U.S. PATENT DOCUMENTS 3,544,110 A * 12/1970 Dickinson ..... 473/456
3,810,616 A * 5/1974 Murphy ..... 473/483
4,482,157 A 11/1984 Mcneil
4,858,920 A 8/1989 Best
5,207,433 A 5/1993 Moore
5,259,612 A 11/1993 Matherne et al.
D355,943 S 2/1995 Cadorniga
5,415,393 A 5/1995 Fitzsimmons et al.

* cited by examiner

*Primary Examiner*—Jeanette Chapman
*Assistant Examiner*—M. Chambers

(57) ABSTRACT

A new combination basketball and football game for combining skills from basketball and football into a challenging game. The inventive device includes a base member having a pole extending upwardly therefrom. The pole has an outwardly curving upper portion. A backboard is secured to a free end of the outwardly curving upper portion of the pole. The backboard has a rim secured to a lower edge thereof. The rim has a net secured thereto. The backboard has an aperture therethrough downwardly of an upper edge thereof. A back net is secured to a rear surface of the backboard. The back net covers the aperture of the backboard. The back net has a pair of openings in a lower end thereof on opposing sides of the outwardly curving upper portion of the pole. A rubber ball is provided having a dimpled outer surface.

7 Claims, 3 Drawing Sheets

COMBINATION BASKETBALL AND FOOTBALL GAME

BACKGROUND OF THE INVENTION

1. Field of the Invention

The present invention relates to sports games and more particularly pertains to a new combination basketball and football game for combining skills from basketball and football into a challenging game.

2. Description of the Prior Art

The use of sports games is known in the prior art. More specifically, sports games heretofore devised and utilized are known to consist basically of familiar, expected and obvious structural configurations, notwithstanding the myriad of designs encompassed by the crowded prior art which have been developed for the fulfillment of countless objectives and requirements.

Known prior art sports games include U. S. Pat. No. 4,482,157 to McNeil; U.S. Pat. No. 5,415,393 to Fitzsimmons et al.; U.S. Pat. No. Des. 355,943 to Cadorniga; U.S. Pat. No. 5,207,433 to Moore; U.S. Pat. No. 4,858,920 to Best; and U.S. Pat. No. 5,259,612 to Matherne et al.

While these devices fulfill their respective, particular objectives and requirements, the aforementioned patents do not disclose a new combination basketball and football game. The inventive device includes a base member having a pole extending upwardly therefrom. The pole has an outwardly curving upper portion. A backboard is secured to a free end of the outwardly curving upper portion of the pole. The backboard has a rim secured to a lower edge thereof. The rim has a net secured thereto. The backboard has an aperture therethrough downwardly of an upper edge thereof. A back net is secured to a rear surface of the backboard. The back net covers the aperture of the backboard. The back net has a pair of openings in a lower end thereof on opposing sides of the outwardly curving upper portion of the pole. A rubber ball is provided having a dimpled outer surface.

In these respects, the combination basketball and football game according to the present invention substantially departs from the conventional concepts and designs of the prior art, and in so doing provides an apparatus primarily developed for the purpose of combining skills from basketball and football into a challenging game.

SUMMARY OF THE INVENTION

In view of the foregoing disadvantages inherent in the known types of sports games now present in the prior art, the present invention provides a new combination basketball and football game construction wherein the same can be utilized for combining skills from basketball and football into a challenging game.

The general purpose of the present invention, which will be described subsequently in greater detail, is to provide a new combination basketball and football game apparatus and method which has many of the advantages of the sports games mentioned heretofore and many novel features that result in a new combination basketball and football game which is not anticipated, rendered obvious, suggested, or even implied by any of the prior art sports games, either alone or in any combination thereof.

To attain this, the present invention generally comprises a base member having a pole extending upwardly therefrom. The pole has an outwardly curving upper portion. A backboard is secured to a free end of the outwardly curving upper portion of the pole. The backboard has a rim secured to a lower edge thereof. The rim has a net secured thereto. The backboard has an aperture therethrough downwardly of an upper edge thereof. Opposed side edges of the backboard each have a panel extending rearwardly therefrom downwardly of the upper edge. A pair of supplemental backboards are secured to the panels of the backboard. Each of the supplemental backboards have a rim secured thereto. Each rim has a net secured thereto. The rims of the supplemental backboards are at an elevation above the rim of the backboard. A back net is secured to a rear surface of the backboard. The back net covers the aperture of the backboard. The back net has a pair of openings in a lower end thereof on opposing sides of the outwardly curving upper portion of the pole. An alarm system is secured to the rear surface of the backboard positioned above the aperture therethrough. The alarm system includes an activation switch. The activation switch is coupled with the back net. The alarm system includes speakers and lights disposed within the backboard. The speakers and lights are in communication with the activation switch.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination basketball and football game apparatus and method which has many of the advantages of the sports games mentioned heretofore and many novel features that result in a new combination basketball and football game which is not anticipated, rendered obvious, suggested, or even implied by any of the prior art sports games, either alone or in any combination thereof.

It is another object of the present invention to provide a new combination basketball and football game which may be easily and efficiently manufactured and marketed.

It is a further object of the present invention to provide a new combination basketball and football game which is of a durable and reliable construction.

An even further object of the present invention is to provide a new combination basketball and football game which is susceptible of a low cost of manufacture with regard to both materials and labor, and which accordingly is then susceptible of low prices of sale to the consuming public, thereby making such combination basketball and football game economically available to the buying public.

Still yet another object of the present invention is to provide a new combination basketball and football game which provides in the apparatuses and methods of the prior art some of the advantages thereof, while simultaneously overcoming some of the disadvantages normally associated therewith.

Still another object of the present invention is to provide a new combination basketball and football game for combining skills from basketball and football into a challenging game.

Yet another object of the present invention is to provide a new combination basketball and football game which includes a base member having a pole extending upwardly therefrom. The pole has an outwardly curving upper portion. A backboard is secured to a free end of the outwardly curving upper portion of the pole. The backboard has a rim secured to a lower edge thereof. The rim has a net secured thereto. The backboard has an aperture therethrough downwardly of an upper edge thereof. A back net is secured to a rear surface of the backboard. The back net covers the aperture of the backboard. The back net has a pair of openings in a lower end thereof on opposing sides of the outwardly curving upper portion of the pole. A rubber ball is provided having a dimpled outer surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
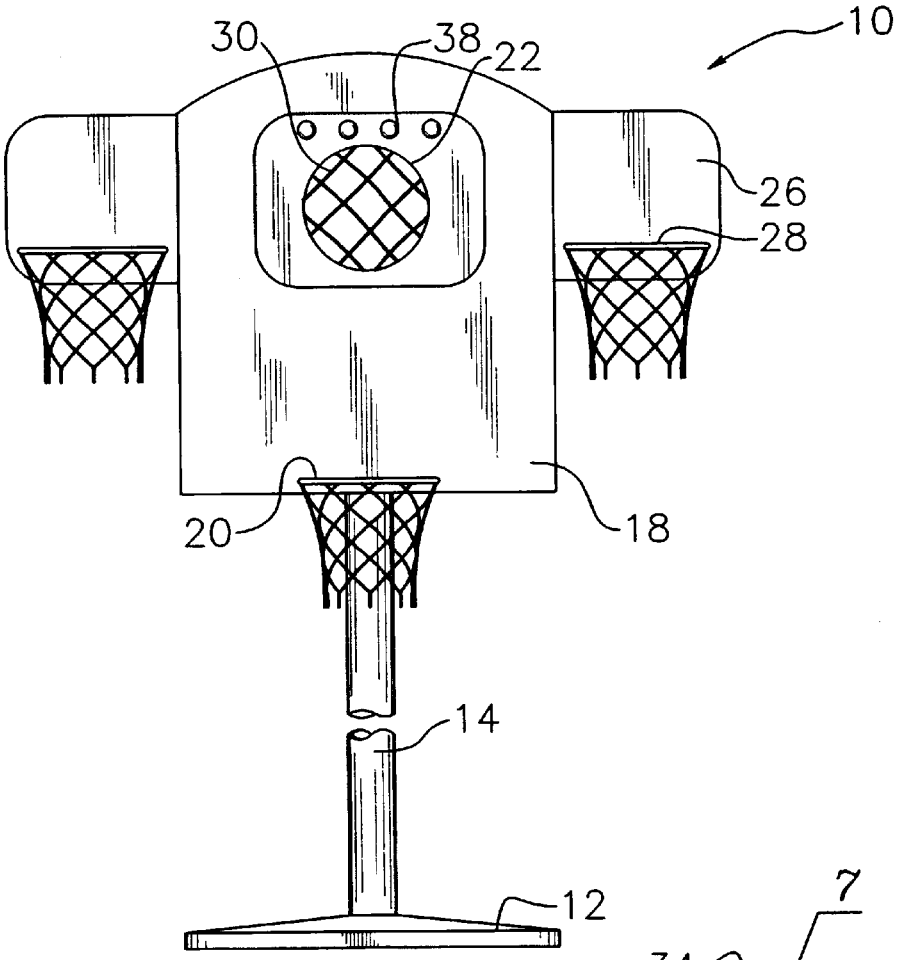
FIG. 1 is a front view of a new combination basketball and football game according to the present invention.
Figure 2:
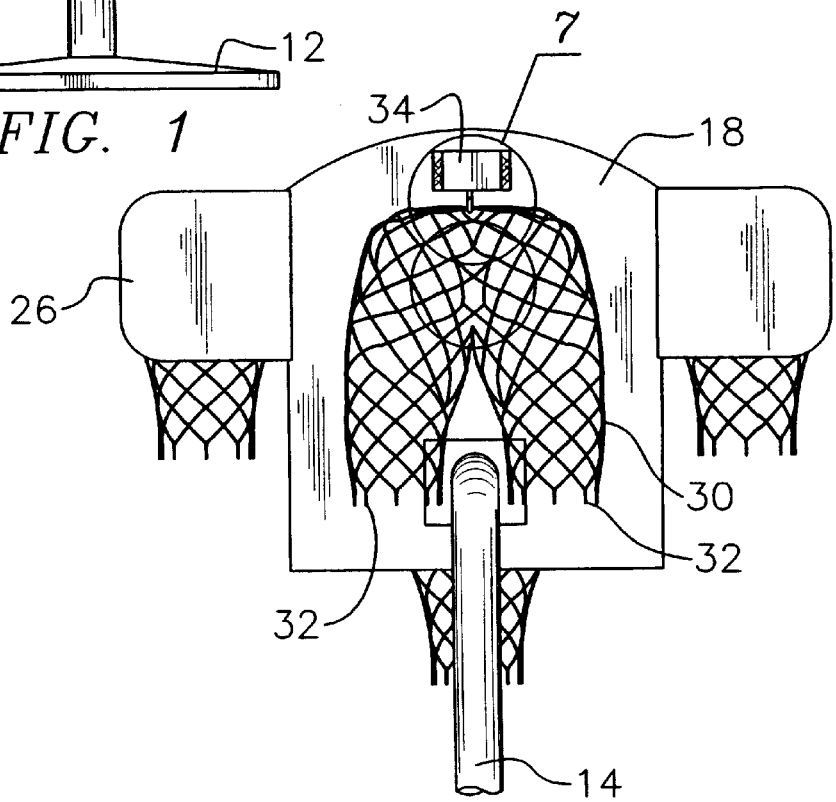
FIG. 2 is a rear view of the present invention.
Figure 3:
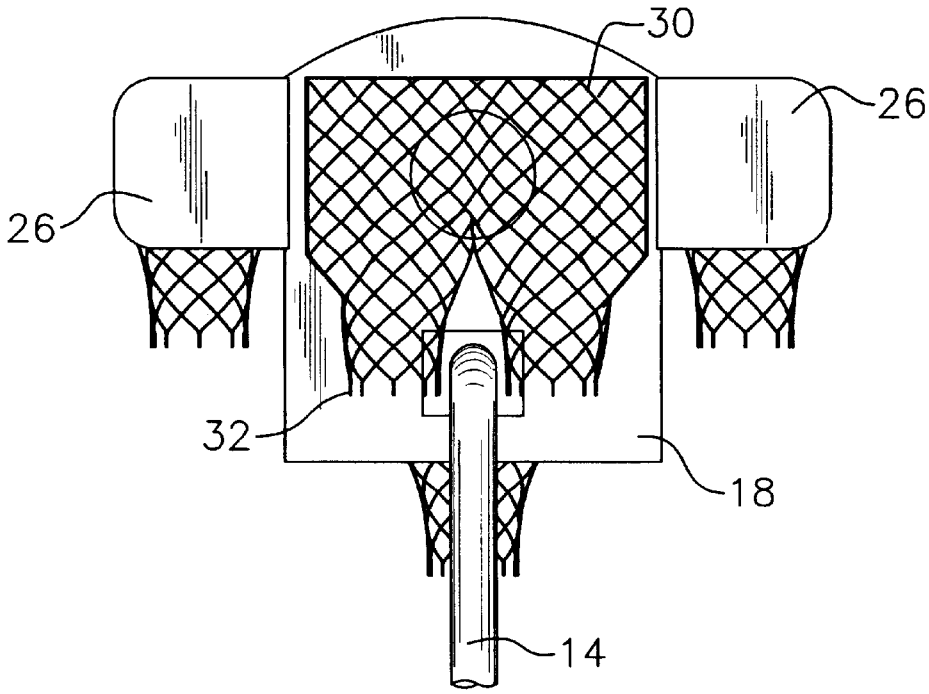
FIG. 3 is an alternate rear view of the present invention.
Figure 4:
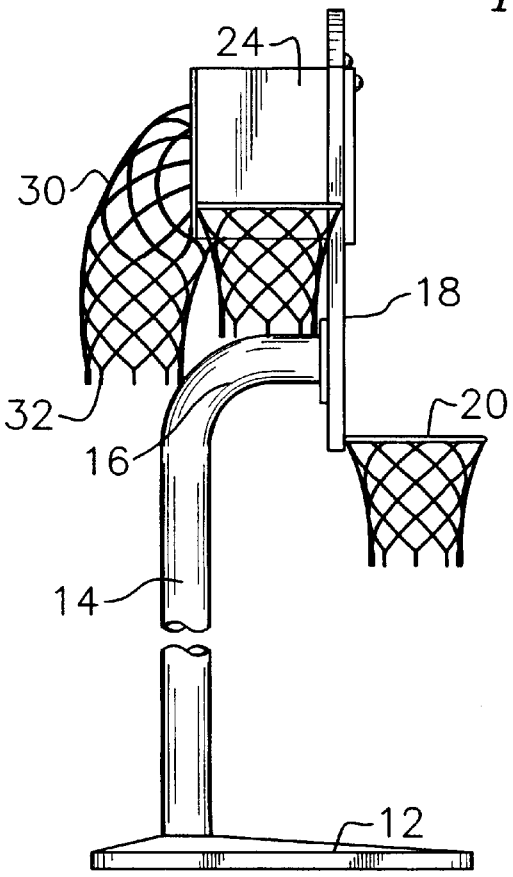
FIG. 4 is a first side view of the present invention.
Figure 5:
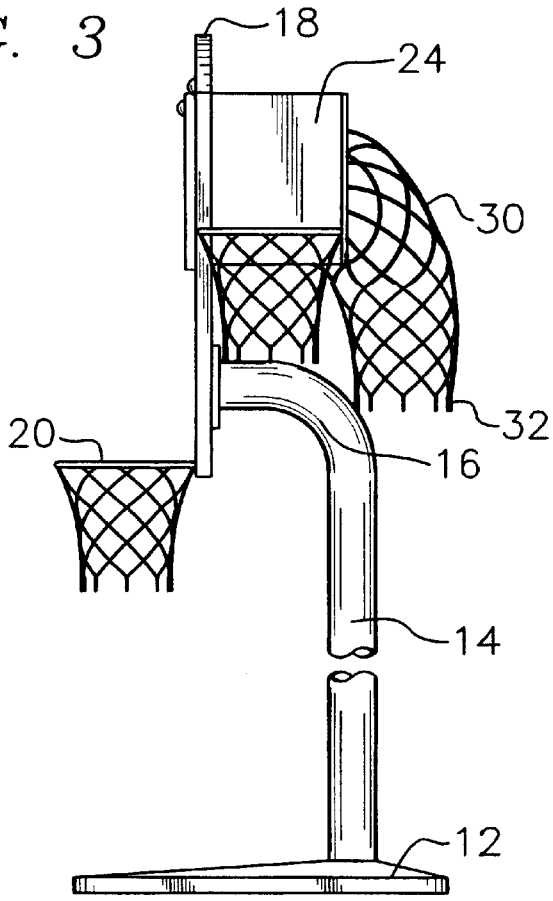
FIG. 5 is a second side view of the present invention.
Figure 6:
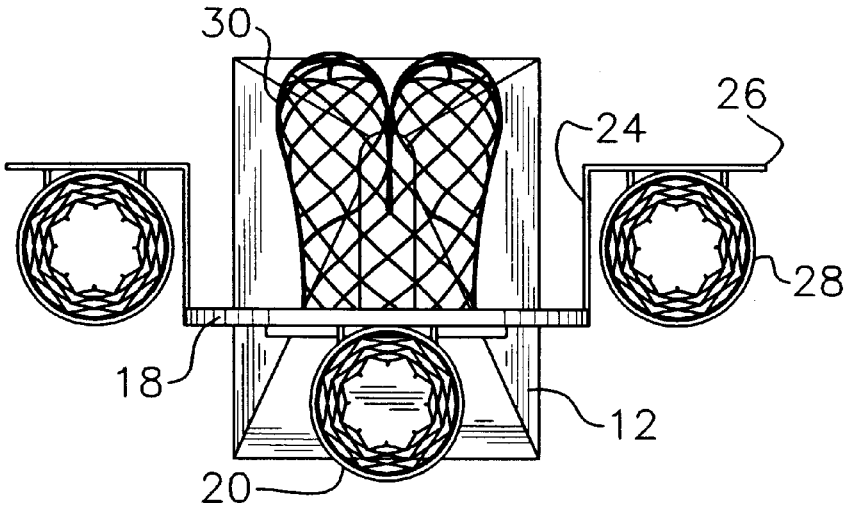
FIG. 6 is a top plan view of the present invention.
Figure 7:
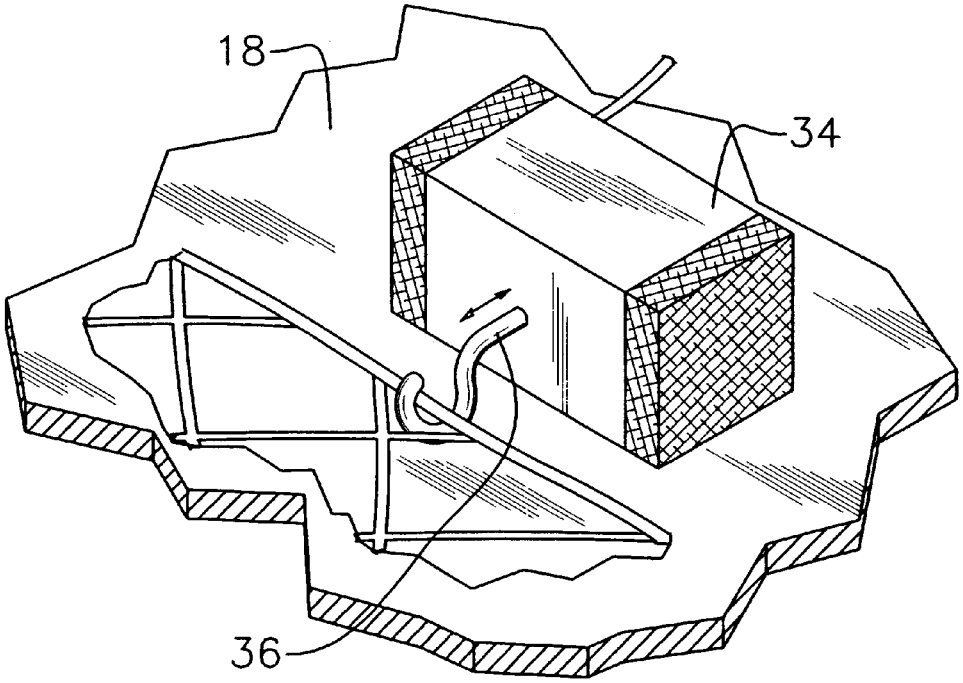
FIG. 7 is a detailed view of the present invention as taken from circle 7 of FIG. 2.
Figure 8:
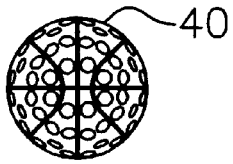
FIG. 8 is a perspective view of a ball of the present invention.

With reference now to the drawings, and in particular to FIGS. 1 through 8 thereof, a new combination basketball and football game embodying the principles and concepts of the present invention and generally designated by the reference numeral 10 will be described.

As best illustrated in FIGS. 1 through 8, the combination basketball and football game 10 comprises a base member 12 having a pole 14 extending upwardly therefrom. The pole 14 has an outwardly curving upper portion 16.

A backboard 18 is secured to a free end of the outwardly curving upper portion 16 of the pole 14. The backboard 18 has a rim 20 secured to a lower edge thereof. The rim 20 has a net secured thereto. The backboard 18 has an aperture 22 therethrough downwardly of an upper edge thereof. The aperture serves as a goal for the present invention. Opposed side edges of the backboard 18 each have a panel 24 extending rearwardly therefrom downwardly of the upper edge.

A pair of supplemental backboards 26 are secured to the panels 24 of the backboard 18. Each of the supplemental backboards 26 have a rim 28 secured thereto. Each rim 28 has a net secured thereto. The rims 28 of the supplemental backboards 26 are at an elevation above the rim 20 of the backboard 18.

A back net 30 is secured to a rear surface of the backboard 18. The back net 30 covers the aperture 22 of the backboard 18. The back net 30 has a pair of openings 32 in a lower end thereof on opposing sides of the outwardly curving upper portion 16 of the pole 14.

An alarm system 34 is secured to the rear surface of the backboard 18 positioned above the aperture 22 therethrough. The alarm system 24 includes an activation switch 36. The activation switch 36 is coupled with the back net 30. The alarm system 34 includes speakers and lights 38 disposed within the backboard 18. The speakers and lights 38 are in communication with the activation switch 36.

A rubber ball 40 is provided having a dimpled outer surface.

In use, the present invention would be played by two teams with up to five or more players on each team. A regulation field would measure approximately fifty yards long by twenty to thirty yards wide and the playing surface could be covered by grass, Astroturf, pavement, or hardwood. When a team gains possession of the ball 40, the players would move the ball up the court by running with the ball 40 or passing to an open teammate. When a player gets an open shot, he would shoot the ball 40 at the rim 20 or the aperture 22 or goal. The player could alternately shoot at one of the rims 28 of the supplemental backboards 26. Since the rim 20 is at the lowest elevation, a made shot therein would be worth less points than through one of the supplemental rims 28. A shot made through the aperture 22 or goal would be worth even more points. Once the ball 40 passes through the aperture 22 and hits the back net 30, the alarm system 34 would be activated and cause the lights and speakers 38 to be activated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new combination basketball and football game for combining skills from basketball and football into a challenging game comprising, in combination:

a base member having a pole extending upwardly therefrom, the pole having an outwardly curving upper portion;

a backboard secured to a free end of the outwardly curving upper portion of the pole, the backboard having a rim secured to a lower edge thereof, the rim having a net secured thereto, the backboard having an aperture therethrough downwardly of an upper edge thereof, opposed side edges of the backboard each having a panel extending rearwardly therefrom downwardly of the upper edge;

a pair of supplemental backboards secured to the panels of the backboard, each of the supplemental backboards having a rim secured thereto, each rim having a net secured thereto, the rims of the supplemental backboards being at an elevation above the rim of the backboard;

a back net secured to a rear surface of the backboard, the back net covering the aperture of the backboard, the back net having a pair of openings in a lower end thereof on opposing sides of the outwardly curving upper portion of the pole;

an alarm system secured to the rear surface of the backboard positioned above the aperture therethrough, the alarm system including an activation switch, the activation switch being coupled with the back net, the alarm system including speakers and lights disposed within the backboard, the speakers and lights being in communication with the activation switch;

a rubber ball having a dimpled outer surface.

2. A combination basketball and football game for combining skills from basketball and football into a challenging game comprising:

a base member having a pole extending upwardly therefrom, the pole having an upper portion;

a backboard secured to a free end of the upper portion of the pole, the backboard having a rim secured adjacent to a lower edge thereof, the rim having a net secured thereto, the backboard having an aperture therethrough downwardly of an upper edge thereof;

a back net secured to a rear surface of the backboard, the back net covering the aperture of the backboard, the back net having a pair of openings in a lower end thereof on opposite sides of the upper portion of the pole;

a ball; and an alarm system secured to the backboard positioned adjacent to the aperture, the alarm system including an activation switch coupled to the back net, the alarm system including speakers and lights disposed on the backboard, the speakers and lights being in communication with the activation switch.

3. The combination basketball and football game as set forth in claim 2 and further including a pair of supplemental backboards secured to rearwardly extending panels of the backboard, each of the supplemental backboards having a rim secured thereto, each rim having a net secured thereto, the rims of the supplemental backboards being at an elevation above the rim of the backboard.

4. A combination basketball and football game for combining skills from basketball and football into a challenging game comprising:

a base member having a pole extending upwardly therefrom, the pole having an upper portion;

a backboard secured to the upper portion of the pole;

a rim mounted on the backboard;

a net secured to the rim;

a back new mounted on a rear surface of the backboard and covering the aperture of the backboard net having a pair of openings in a lower end thereof;

at least one supplemental backboard mounted on the backboard, the at least one supplemental backboard having a rim secured thereto, the rim having a net secured thereto, the rim of the at least one supplemental backboards being at an elevation above the rim of the backboard.

5. The combination basketball and football game as set forth in claim 4 and further including a ball.

6. The combination basketball and football game as set forth in claim 4 and further including an alarm system mounted on the backboard, the alarm system including an activation switch coupled to the back net, the alarm system including a sound emitting device disposed on the backboard, the sound emitting device being in communication with the activation switch.

7. The combination basketball and football game as set forth in claim 4 wherein a pair of the supplemental backboards are mounted on the backboard.

* * * * *